US007812695B2

(12) United States Patent
McCoy

(10) Patent No.: US 7,812,695 B2
(45) Date of Patent: Oct. 12, 2010

(54) TIE BAR FOR THREE POLE SWITCHING DEVICE

(75) Inventor: Brian Timothy McCoy, Lawrenceville, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 98 days.

(21) Appl. No.: 11/983,230

(22) Filed: Nov. 8, 2007

(65) Prior Publication Data

US 2008/0191820 A1 Aug. 14, 2008

Related U.S. Application Data

(60) Provisional application No. 60/865,051, filed on Nov. 9, 2006.

(51) Int. Cl.
*H01H 75/00* (2006.01)
*H01H 77/00* (2006.01)
*H01H 83/00* (2006.01)

(52) U.S. Cl. ..... 335/8; 335/10

(58) Field of Classification Search ..... 335/8–10, 335/20

See application file for complete search history.

(56) References Cited

U.S. PATENT DOCUMENTS 3,145,281 A 8/1964 Ingwesen
3,194,922 A * 7/1965 Ellsworth et al. ..... 337/50
3,414,850 A * 12/1968 Cooper ..... 335/8
4,110,719 A 8/1978 Kirkup
4,121,077 A * 10/1978 Mrenna et al. ..... 200/308
4,382,240 A * 5/1983 Kondo et al. ..... 335/8
4,600,908 A * 7/1986 Uchida et al. ..... 335/8
4,754,162 A * 6/1988 Kondou et al. ..... 307/112
RE33,325 E * 9/1990 Yokoyama et al. ..... 335/14
5,117,208 A * 5/1992 Nar ..... 335/8
5,157,366 A * 10/1992 Mullins et al. ..... 335/8
5,262,744 A * 11/1993 Arnold et al. ..... 335/8
5,381,121 A * 1/1995 Peter et al. ..... 335/20
5,467,069 A * 11/1995 Payet-Burin et al. ..... 335/42
6,259,338 B1 * 7/2001 Boeder et al. ..... 335/6
6,531,938 B1 * 3/2003 Smith et al. ..... 335/14
2008/0041704 A1 * 2/2008 McCoy ..... 200/50.32
2008/0135391 A1 * 6/2008 McCoy ..... 200/331

* cited by examiner

*Primary Examiner*—Elvin G Enad
*Assistant Examiner*—Alexander Talpalatskiy
(74) *Attorney, Agent, or Firm*—Jose de la Rosa

(57) ABSTRACT

A multipole switching device selectively switches electrical power from an electrical power source to a load circuit. A first control device comprises a housing mountable in a panel, an electromechanical actuator in the housing including a movable plunger, and an electrical switch in the housing operated by the plunger. A second control device comprises a housing mountable in a panel, adjacent the first control device, a mechanical actuator in the housing including a movable link, and an electrical switch in the housing operated by the movable link. A third control device comprises a housing mountable in a panel, adjacent the second control device, an electromechanical actuator in the housing including a movable plunger, and an electrical switch in the housing operated by the plunger. A tie linkage mechanically ties the first control device plunger and the third control device plunger to the movable link.

18 Claims, 9 Drawing Sheets

TIE BAR FOR THREE POLE SWITCHING DEVICE

CROSS REFERENCE TO RELATED APPLICATIONS

This application claims priority of provisional application No. 60/865,051 filed Nov. 9, 2006, the contents of which is incorporated by reference herein.

FIELD OF THE INVENTION

This invention relates generally to residential and commercial electrical power distribution panels and components, and more particularly, to a tie bar for a three pole switching device for controlling loads, particularly lighting loads and air conditioning loads, in an electrical power distribution system.

BACKGROUND OF THE INVENTION

Circuit breaker panels are used to protect electrical circuitry from damage due to an overcurrent condition, such as an overload, a relatively high level short circuit, or a ground fault condition. To perform that function, circuit breaker panels include circuit breakers that typically contain a switch unit and a trip unit. The switch unit is coupled to the electrical circuitry (i.e., lines and loads) such that it can open or close the electrical path of the electrical circuitry. The switch unit includes a pair of separable contacts per phase, a pivoting contact arm per phase, an operating mechanism, and an operating handle.

In the overcurrent condition, all the pairs of separable contacts are disengaged or tripped, opening the electrical circuitry. When the overcurrent condition is no longer present, the circuit breaker can be reset such that all the pairs of separable contacts are engaged, closing the electrical circuitry.

In addition to manual overcurrent protection via the operating handle, automatic overcurrent protection is also provided via the trip unit. With an electromechanical tripping type circuit breaker, the trip unit senses the electrical circuitry for the overcurrent condition and automatically trips the circuit breaker. When the overcurrent condition is sensed, a tripping mechanism included in the trip unit actuates the operating mechanism, thereby disengaging the first contact from the second contact for each phase. Typically, the operating handle is coupled to the operating mechanism such that when the tripping mechanism actuates the operating mechanism to separate the contacts, the operating handle also moves to a tripped position.

Switchgear and switchboard are general terms used to refer to electrical equipment including metal enclosures that house switching and interrupting devices such as fuses, circuit breakers and relays, along with associated control, instrumentation and metering devices. The enclosures also typically include devices such as bus bars, inner connections and supporting structures (referred to generally herein as "panels") used for the distribution of electrical power. Such electrical equipment can be maintained in a building such as a factory or commercial establishment, or it can be maintained outside of such facilities and exposed to environmental weather conditions. Typically, hinge doors or covers are provided on the front of the switchgear or switchboard sections for access to the devices contained therein.

In addition to electrical distribution and the protection of circuitry from overcurrent conditions, components have been added to panels for the control of electrical power to loads connected to circuit breakers. For example, components have been used to control electrical power for lighting.

One system used for controlling electrical power to loads utilizes a remote-operated circuit breaker system. In such a system, the switch unit of the circuit breaker operates not only in response to an overcurrent condition, but also in response to a signal received from a control unit separate from the circuit breaker. The circuit breaker is specially constructed for use as a remote-operated circuit breaker, and could contain a motor or other actuating means for actuating the switch unit.

In an exemplary remote-operated circuit breaker system, a control unit is installed on the panel and is hard-wired to the remote-operated circuit breaker through a control bus. When the switch unit of the circuit breaker is to be closed or opened, an operating current is applied to or removed from the circuit breaker actuating means directly by the control panel. Additional, separate conductors are provided in the bus for feedback information such as contact confirmation, etc., for each circuit breaker position in the panel. The control unit contains electronics for separately applying and removing the operating current to the circuit breakers installed in particular circuit breaker positions in the panel. The panel control unit also has electronics for checking the state of the circuit breaker, diagnostics, etc. One advantage of that system is that the individual circuit breakers can be addressed according to their positions in the panel.

Operation of remote operated circuit breakers becomes more difficult when the need exists for a two or three pole unit to provide multiple sets of switching contacts for the control of air conditioning and meter loads. A plurality of single pole devices may be operated at the same time to simulate a multipole device. However, timing issues can exist with such a configuration. Also, if one of the devices fails or is operated oppositely to that intended, improper load operation could result. Moreover, separate control circuitry is necessary for each of the individual single pole units. Previously, such circuitry has been external to the switching device due to component size and the amount of power required. Locating communication circuitry outside the switching device necessitates the circuitry always being present in the panelboard even if the switching device is not.

Alternatively, or additionally, the contact arms of multipole devices can be mechanically linked by a crossbar that normally pivots at the same point as the contact arms and ensures that the contact arms move/rotate at the same time. However, the use of a crossbar may not be feasible with modular devises, or the like. It is necessary that the individual poles be in the same on/off position, while still allowing sufficient provisions for the over travel of any individual pole as a result of contact wear and tolerance issues.

The present invention is directed to a tie bar in a three pole switching device.

SUMMARY OF THE INVENTION

In accordance with the invention, there is provided a tie bar in a three pole switching device in an electrical power distribution system.

The present invention is directed to a tie bar system in a three pole switching device that takes the place of a conventional crossbar design by utilizing a series of linkages that ensure that all three poles of the switching device are in the same position (open or closed) at any given time. This is achieved by linking the poles at the contact arm "wrist pin" joint of each pole instead of at the contact arm "pivot" location as used on conventional crossbar designs. This tie bar system is designed to utilize an overall modular concept for the three pole switching device that uses several parts that are common to one and two pole switching devices as opposed to a conventional crossbar design that would have required more custom parts than the present tie bar system.

In accordance with one aspect of the invention, there is disclosed a multipole switching device for selectively switching electrical power from an electrical power source to a load circuit. A first control device comprises a housing mountable in a panel, an electromechanical actuator in the housing including a movable plunger, and an electrical switch in the housing operated by the plunger. A second control device comprises a housing mountable in a panel, adjacent the first control device, a mechanical actuator in the housing including a movable link, and an electrical switch in the housing operated by the movable link. A third control device comprises a housing mountable in a panel, adjacent the second control device, an electromechanical actuator in the housing including a movable plunger, and an electrical switch in the housing operated by the plunger. A tie linkage mechanically ties the first control device plunger and the third control device plunger to the movable link.

It is a feature of the invention that the tie linkage comprises first and second rods operatively associated with the respective first control device plunger and the third control device plunger.

It is another feature of the invention that the tie link further comprises a tie bar in the second control device housing operatively coupled to the first and second rods and to the movable link.

It is another feature of the invention that the tie bar is pivotally mounted in the second control device housing and has opposite hubs receiving the first and second rods.

It is still another feature of the invention that the first and second rods extend into a slot in the movable link.

It is still a further feature of the invention that the first and second rods comprise double bent rods.

It is still another feature of the invention that the first rod mechanically links the plunger to a contact arm of the first control device electrical switch and the second rod mechanically links the plunger to a contact arm of the third control device electrical switch.

It is yet another feature of the invention that the movable link comprises an elongate bar having a slot receiving the first and second rods to compensate for contact wear and having an opening receiving a wrist pin mechanically linking the movable link to a contact arm of the second control device electrical switch.

It is still another feature of the invention that the electromechanical actuators comprise solenoids.

There is disclosed in accordance with another aspect of the invention a three pole switching device for selectively switching electrical power from an electrical power source to a load circuit comprising first, second and third control modules. The first and third control modules each comprise a housing mountable in a panel, an electromechanical actuator in the housing including a movable plunger, and an electrical switch in the housing comprising a fixed contact and a movable contact, the movable contact being carried on a contact arm operated by the plunger. The second control module comprises a housing mountable in a panel, a mechanical actuator in the housing including a movable link, and an electrical switch in the housing comprising a fixed contact and a movable contact, the movable contact being carried on a contact arm operated by the movable link. The second control module is mounted adjacent the first control module and the third control module. A tie linkage mechanically ties the first control module contact arm and the third control module contact arm to the movable link.

Further features and advantages of the invention will be readily apparent from the specification and the drawings.

DETAILED DESCRIPTION OF THE INVENTION

An electrical distribution system, such as an integrated lighting control system, in accordance with the invention permits a user to control power circuits typically used for lighting, as well as circuits for resistive heating or air conditioning, using multipole remote operated relays. The electrical distribution system may be as is generally described in U.S. application Ser. No. 11/519,727, filed Sep. 12, 2006, the specification of which is incorporated by reference herein, or as is more specifically described in U.S. application Ser. No. 11/635,299, filed Dec. 7, 2006, the specification of which is incorporated by reference herein.

Figure 1:
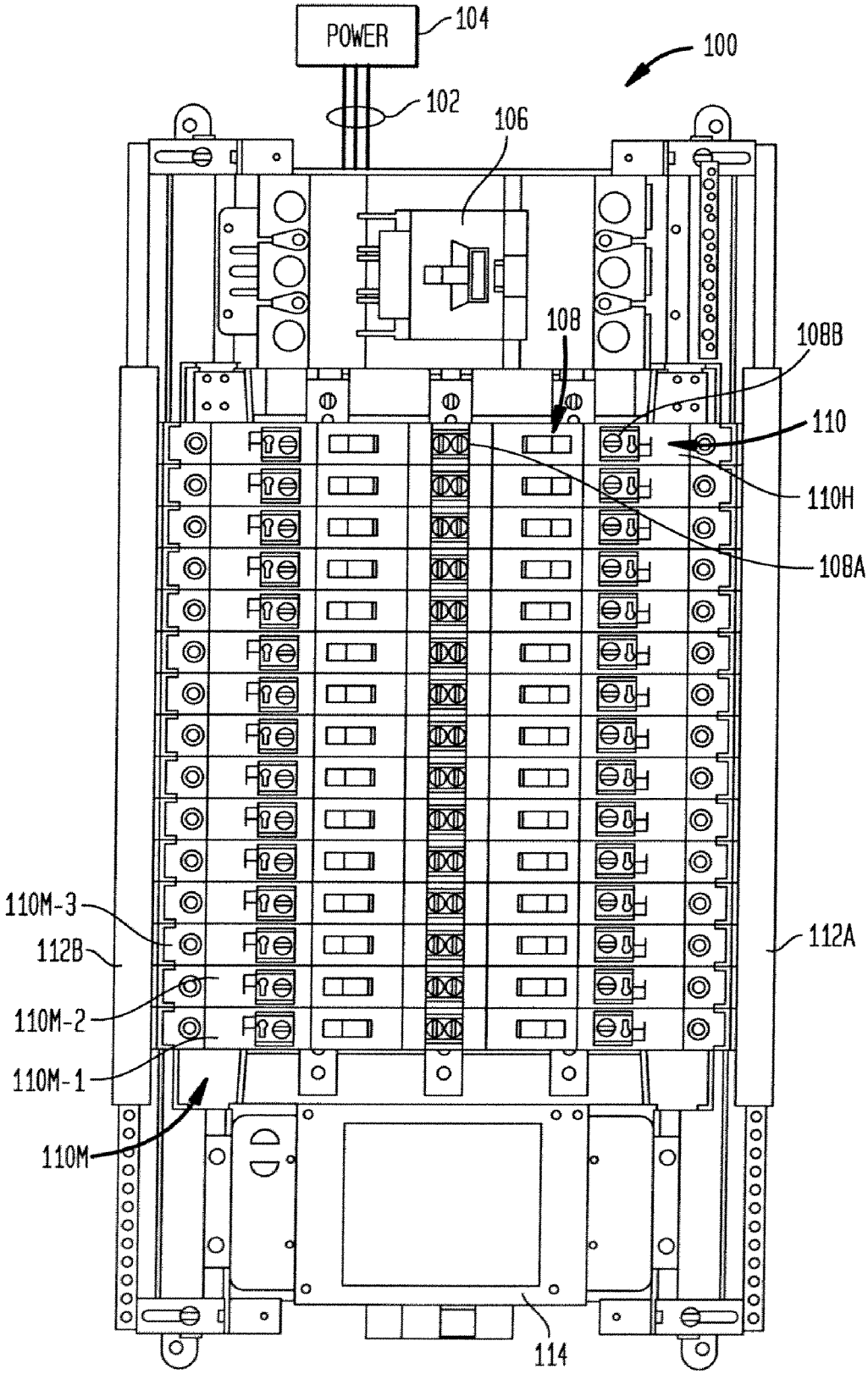
FIG. 1 is an elevation view of a power distribution panel according to the invention.

Referring to FIG. 1, a lighting control system in accordance with the invention comprises a lighting control panel 100. The panel 100 may comprise a Siemens type PI panelboard, although the invention is not limited to such a configuration. Line power enters the panel 100 through power source cables 102 connected to a source of power 104. Line power may, for example, be a three phase 480Y277, 240 or 120 VAC power source, as is conventional. The cables 102 are electrically connected to an input side of a main breaker 106. The main breaker 106 distributes line power to individual circuit breakers 108 in a conventional manner. How the power is distributed depends on design of the individual circuit breakers 108, as will be apparent to those skilled in the art. The power is distributed to the line side of individual circuit breakers 108. The panel 100 may be configured to accept forty two or more individual circuit breakers 108, although only thirty are shown in the embodiment of FIG. 1. Each circuit breaker may be of conventional construction and may be, for example, a Siemens BQD circuit breaker. Each circuit breaker 108 includes a line terminal 108A receiving power from the main breaker 106 and a load terminal 108B conventionally used for connecting to a load circuit.

For simplicity of description, when a device such as a circuit breaker 108 is described generally herein the device is referenced without any hyphenated suffix. Conversely, if a specific one of the devices is described it is referenced with a hyphenated suffix, such as 108-1.

In accordance with the invention, each load circuit to be controlled also has a remote operated device 110, such as a relay, a meter or a dimmer. The term remote operated device as used herein includes any other devices that controls, monitors or may otherwise be used in a load circuit, in accordance with the invention. While in a preferred embodiment, the remote operated device 110 is a separate component from the circuit breaker 108, the term "remote operated device" as used herein encompasses devices integral with the circuit breaker. The remote operated devices 110 are also connected to data rails 112A and 112B. A panel controller 114 controls the remote operated devices 110 through connections provided via the data rails 112A and 112B, as discussed below.

The remote operated device 110 includes a housing 110H encasing an auxiliary set of contacts that can be remotely operated to open and close a lighting circuit. The device 110 is attached to the load side of a circuit breaker 108 within a panel 100 using a conductor tab, i.e, the terminal 110A, inserted into the breaker lug 108B, see FIG. 2. The load terminal 110B comprises a lug of the same size as the breaker lug 108B for connecting to a wire to be connected to the load device. The device housing 110H is configured to mount in a Siemens type PI panelboard, although the invention is not limited to such a configuration.

Figure 2:
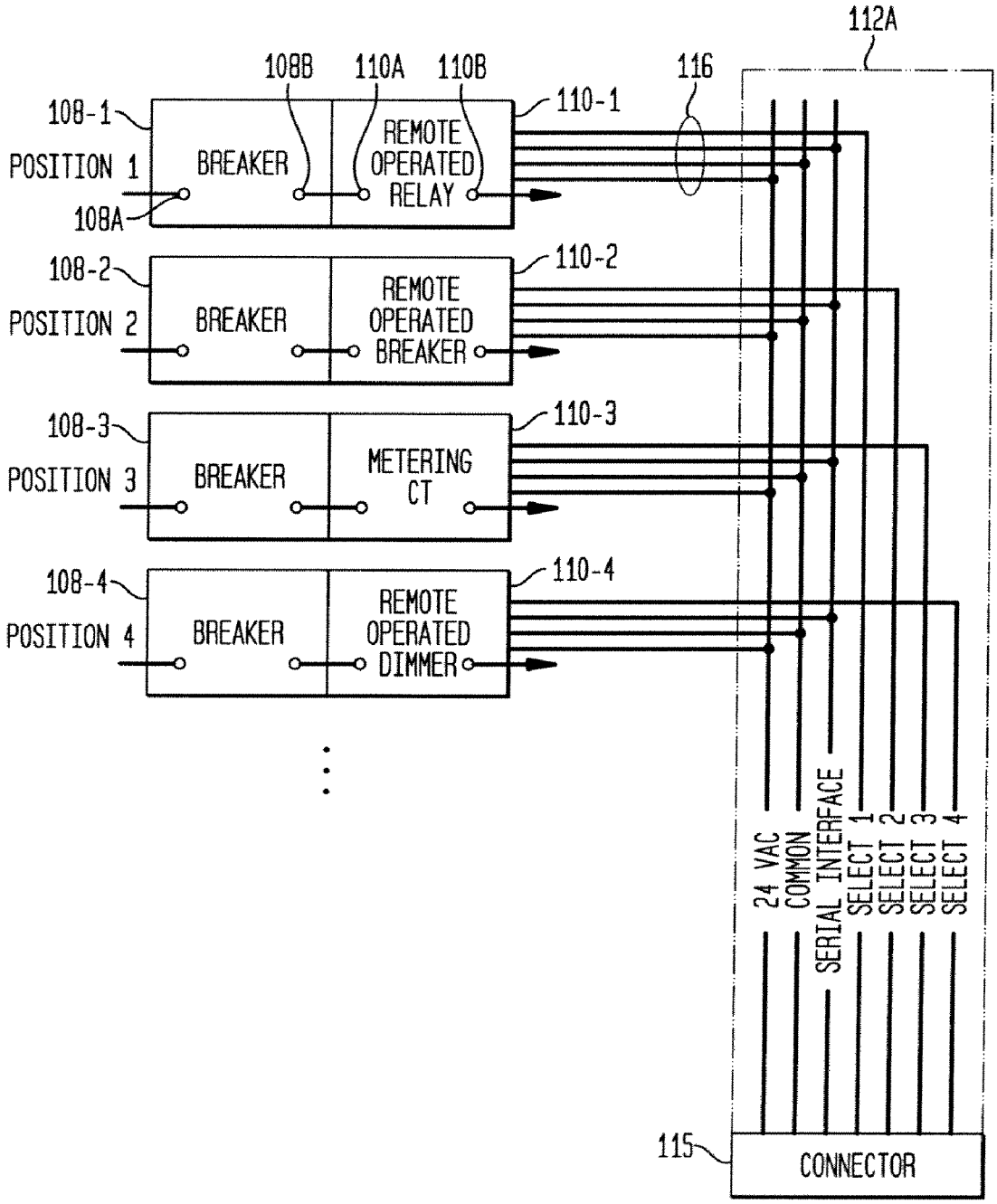
FIG. 2 is a block diagram illustrating pairs of circuit breakers and remote operated devices of the power distribution panel of FIG. 1.

Referring to FIG. 2, a block diagram illustrates four circuit breakers 108-1, 108-2, 108-3 and 108-4, and respective associated remote operated devices 110-1, 110-2, 110-3 and 110-4. In the illustrated embodiment, the first device 110-1 comprises a relay, the second device 110-2 comprises a breaker, the third device 110-3 comprises a current transformer, and the fourth device 110-4 comprises a dimmer. As is apparent, any combination of these remote operated devices 110 could be used. Each remote operated device 110 includes an input terminal 110A electrically connected to the associated circuit breaker load terminal 108B, and an output terminal 110B for connection to a load device.

The data rail 112 is mechanically attached directly to the interior of the lighting control panel 100. The data rail 112 comprises a shielded communication bus including a ribbon connector 115 having conductors to be routed to the panel controller 114. A wire harness 116 connects the data rail 112 to the remote operated device 110.

A detailed description of the data rail 112 and panel controller 114 are not provided herein. Instead, reference may be made to the detailed discussion of the same in the applications incorporated by reference herein. Indeed, the present invention does not require use of either a panel controller or data rail, as will be apparent.

The remote operated device 110, in the form of a relay, allows remote switching of an electrical branch load. The device 110 is designed to fit inside a standard electrical panel board with forty-two or more branch circuit breakers 108. The device 110 is an accessory to a branch circuit breaker 108 allowing repetitive switching of the load without effecting operation of the circuit breaker 108.

The remote operator device 110 requires a means to receive command signals to open or close and to report back successful operation or device status. Also required is a means to drive opening and closing of the switch mechanism contacts. In accordance with the invention, the remote operator device is a multipole switching device that uses two magnetically held solenoids as an actuator device and one electronic circuit board similar to a single pole device with a tie linkage mechanically linking the devices. With this design, electronic control circuitry is located inside the switching device itself. Only one circuit is needed to operate both actuators. The use of two magnetically held solenoids or "mag latches" as switching actuators results in very low energy requirements, requires short duration pulses to change position (measured in milliseconds), provides accurate and repeatable timing and requires that the control must reverse voltage polarity. Moreover, the two solenoids indirectly operate a third pole using a mechanical linkage, as described below.

Figure 3:
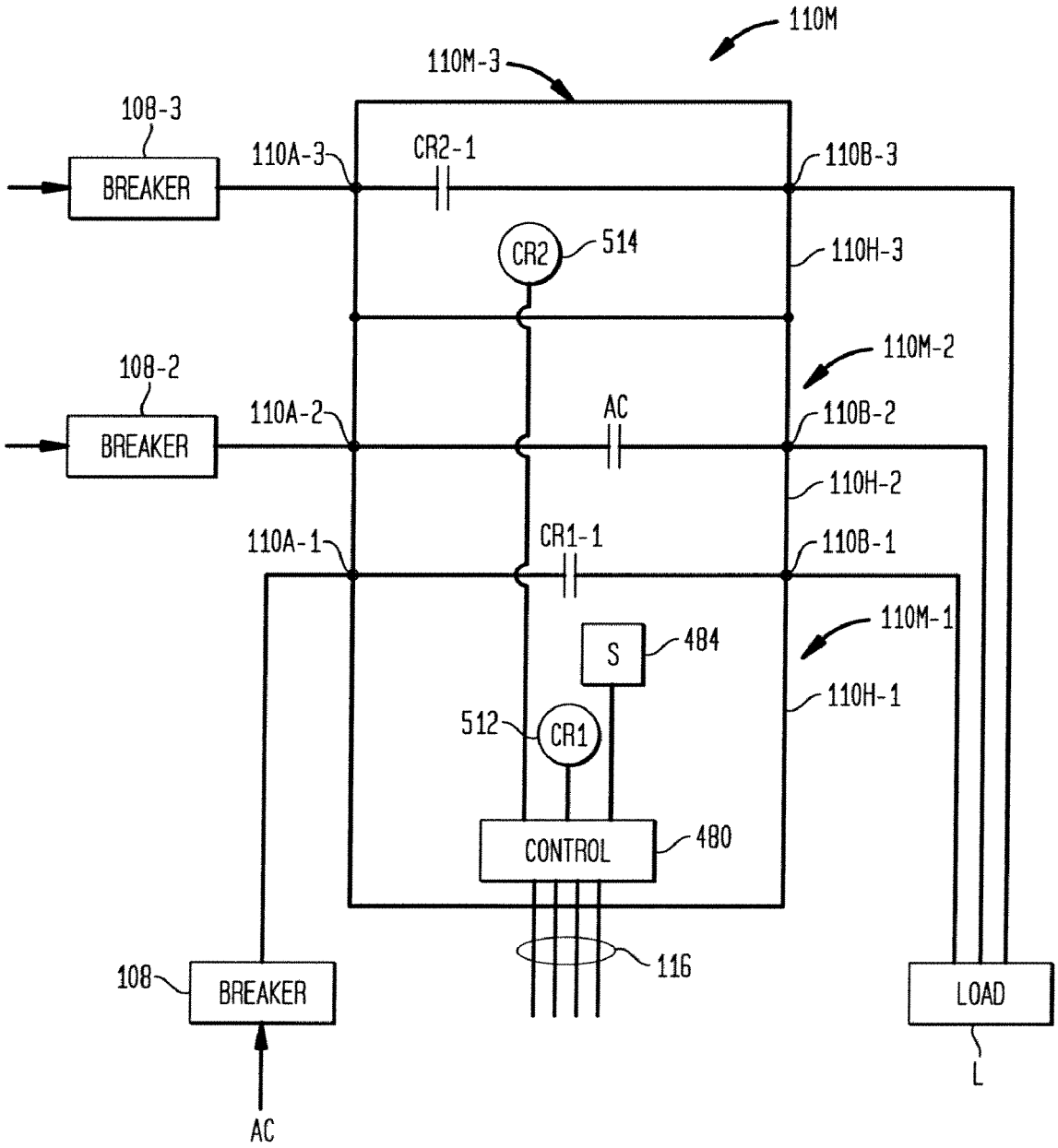
FIG. 3 is a basic block diagram of a multipole switching device in accordance with the invention.

FIG. 3 illustrates a basic functional block diagram for multipole load switching. The remote operated device, in the form of a three pole remote operated switching device 110M includes a first control module 110M-1, a second control module 110M-2 and a third control module 110M-3 having respective housings 110H-1, 110H-2 and 110H-3 mounted adjacent one another, as illustrated in FIG. 1, to form a three pole device. As is apparent, the first pole could be in the first control module 110M-1, the second pole could be in the second control module 110M-2 and the third pole be in the third control module 110M-3. Alternatively, the third pole could be in the first control module 110M-1, the second pole could be in the second control module 110M-2 and the first pole be in the third control module 110M-3.

The second control module 110M-2 is mounted between the first control module 110M-1 and the third control module 110M-3. A control circuit 480 incorporated in a printed circuit board in the first housing 110H-1 is connected to the wire harness 116 for connection to the data rail 112, see also FIG. 2. The control circuit 480 drives two control relays CR1 and CR2, in the respective first and third housings 110H-1 and 110H-3. The first control relay CR1 operates an electrical switch in the form of a normally open contact CR1-1 connected between terminals 110A-1 and 110B-1. The second control relay CR2 operates an electrical switch in the form of a normally open contact CR2-1 connected between terminals 110A-3 and 110B-3. A tie linkage in accordance with the invention, as described below, driven collectively by the two control relays CR1 and CR2 operates an electrical switch in the form of a normally open contact AC between terminals 110A-2 and 110B-2 in the second control module housing 110H-2. A sensor 484 senses status of the relays and is connected to the control circuit 480. As such, the control circuit 480 controls operation of the contact CR1, CR2 and AC to selectively electrically connect a load to the breakers 108-1, 108-2 and 108-3, and thus to power the load L.

Figure 4:
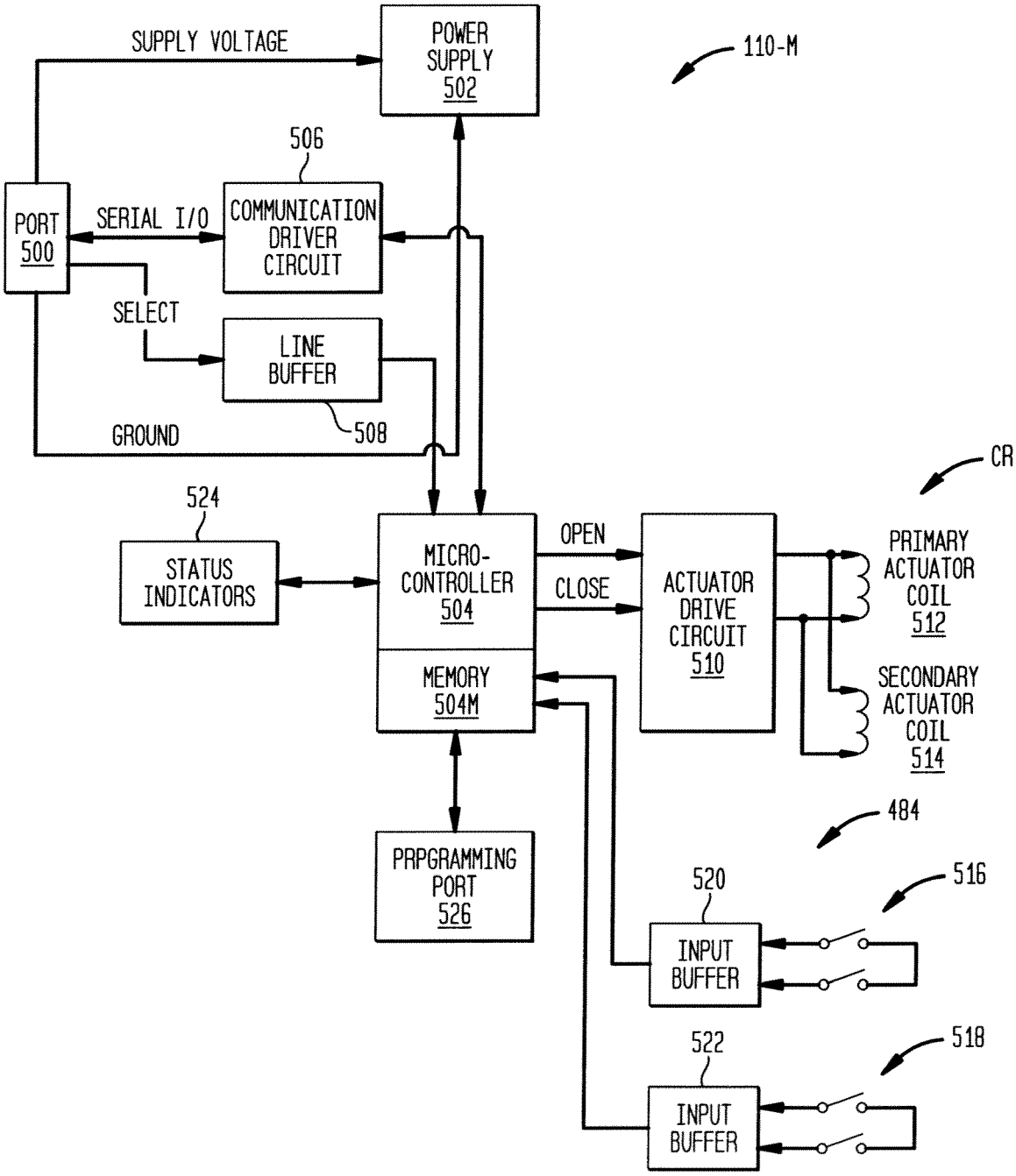
FIG. 4 is a detailed block diagram of the multipole switching device of FIG. 3.

FIG. 4 illustrates a detailed block diagram of the remote operated device 110-M. Connection to the data rail 112 is through a four wire port 500. The port 500 includes a positive supply voltage and ground, a serial communication line, and a select line, as discussed above. The supply voltage and ground are fed to a power supply 502 to generate voltage as needed for a microcontroller 504 and other circuits. A communication driver circuit 506 is used to isolate and drive a single wire serial communication line between the microcontroller 504 and the port 500 and thus the data rail 112. As discussed above, the single wire connection to each remote operated device 110 and to the panel controller 114 is used to transmit and receive commands and data. This provides necessary isolation and protection. In the event of an individual device failure, the remainder of the devices continue to operate properly. The select line from the port 500 is buffered in a line buffer 508 and connected to the microcontroller 504. This select line is used to enable or disable communications to and from the remote operated device 110-M. By selecting more than one remote operated device, the I/O controller 124 can send commands or messages to multiple devices 110 at the same time, reducing traffic on the serial communication bus.

The microcontroller 504 comprises a conventional microcontroller and associated memory 504M, the memory storing software to run in the microcontroller 504.

The microcontroller 504 has OPEN and CLOSE lines to an actuator drive circuit 510. The control relays CR1 and CR2 in the illustrated embodiment of the invention comprise magnetically held solenoids including a primary actuator coil 512 and a secondary actuator coil 514, see also FIG. 6, connected in parallel to the actuator drive circuit 510. The actuator drive circuit 510 provides current for both coils 512 and 514. An OPEN signal causes the drive circuit to apply negative voltage to the actuator coils for a short period of time (about 10 to 30 milliseconds). This causes actuator plungers 530 and 532 to pull-in and become magnetically latched or held in the open position to open the contacts CR1-1 and CR2-1, see FIG. 3, in a conventional manner. Power is then removed from the coils 512 and 514. A CLOSE signal from the microcontroller 504 causes the drive circuit 510 to apply a positive voltage to the actuator coils 512 and 514 for a shorter period of time (about 2 to 3 milliseconds). This period of time is sufficient for the actuator plungers 530 and 532 to become unlatched or released and springs (not shown) force them to the closed position to close the contacts CR1-1 and CR2-1, see FIG. 3. Again, power is then removed from the coils 512 and 514. Since the actuators are stable in both the open and closed positions, energy is only required to change position. This results in a low energy solution even with two coils in parallel. Also included in the actuator drive circuit 510 is protection from both open and closed signals applied at the same time, which could result in a short circuit of the power supply 502.

Feedback for actuator plunger and link positions is provided by the sensor 484 in the form of two auxiliary position switches, a primary position switch 516 and a secondary position switch 518, such as series connected secondary and tertiary auxiliary relay contacts. The signals are buffered in respective input buffers 520 and 522 and then connected to the microcontroller 504. The microcontroller 504 uses the feedback information to respond to an I/O controller request for status or to retry a failed open or close attempt.

Additionally, the microcontroller 504 can send signals to various types of status indicators 524 such as LEDs to show open, closed, communications OK, operating properly, low voltage, etc. A programming port 526 can be used to program or update the microcontroller software or to load parameters such as on/off pulse rates or to troubleshoot the device 110.

Figure 5:
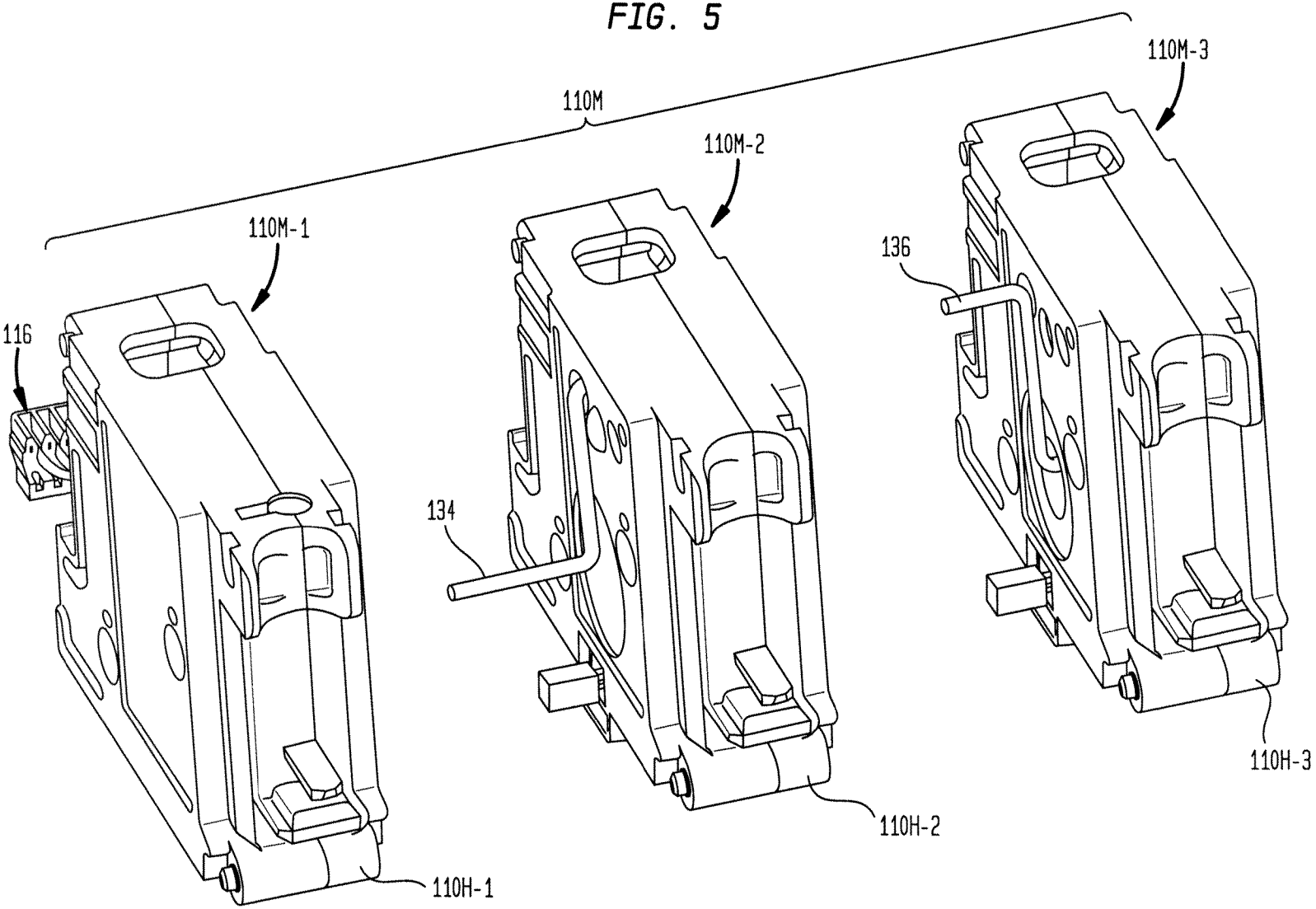
FIG. 5 is an exploded perspective view of a three pole switching device in accordance with the invention.
Figure 6:
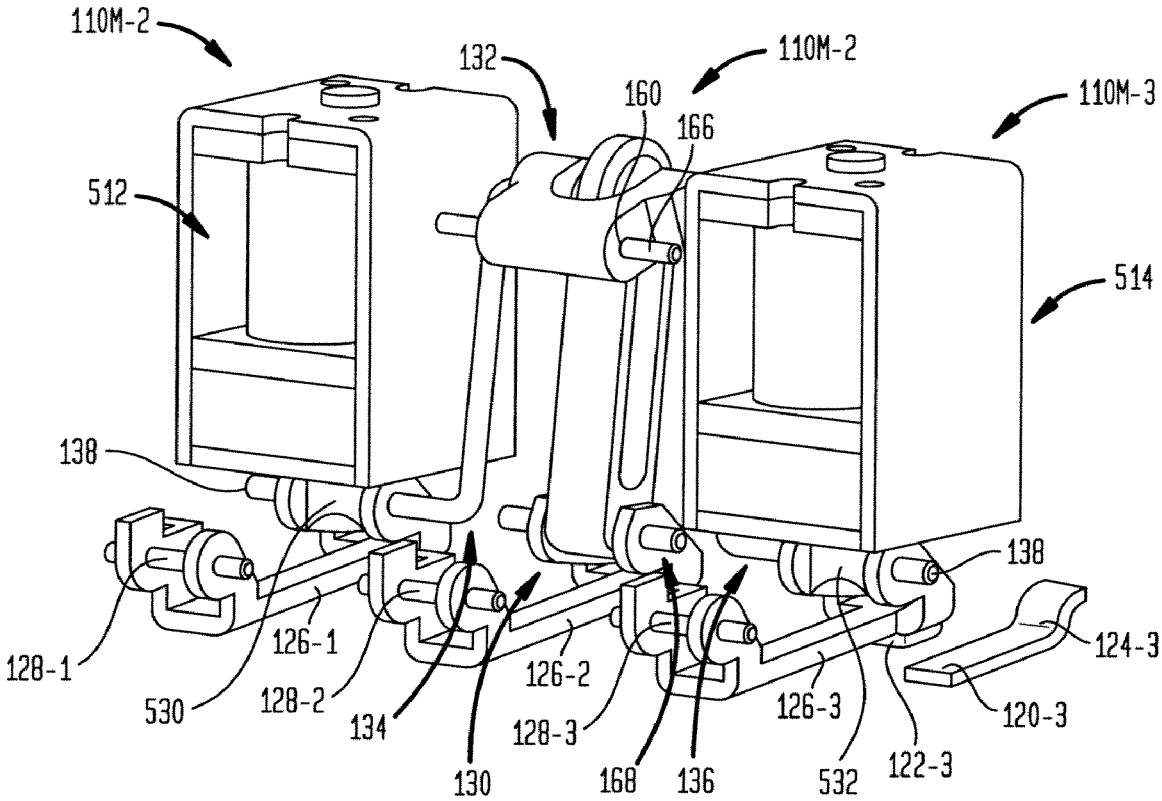
FIG. 6 is a perspective view illustrating mechanical linking of solenoids in the three pole switching device of FIG. 5.

Referring to FIG. 5, the three control modules are illustrated in spaced apart relationship. As described above, the first control module housing 110H-1 includes the circuitry for operating the control relay CR1 housed therein, and a control relay CR2 housed in the third control module 110H-3. An electromechanical linkage with the first and third control modules 110M-1 and 110M-3 operates an electrical switch in the second control module 110M-2. FIG. 6 illustrates the electromechanical devices to form a three pole switching device, with the housings, circuitry and the like omitted for clarity.

As shown in FIG. 6, the third control module electrical switch, shown schematically as CR2-1 in FIG. 3, comprises a fixed contact 120-3 and a movable contact 122-3. The fixed contact 120-3 is mounted to a terminal strap 124-3 fixedly mounted in the housing 110H-3, in a conventional manner, for connection to the terminal 110B-3, see FIG. 3. The movable contact 122-3 is carried on a contact arm 126-3 pivotally mounted in the housing 110H-3 using a contact arm pivot 128-3. The contact arm is electrically connected in any known manner to the terminal 110A-3, see FIG. 3. The electrical switch structure of the first control module 110M-1 and the second control module 110M-2 are generally similar and are not described in detail.

In accordance with the invention, the second control module 110M-2 does not use a solenoid. Instead, mechanical actuation is provided by a center pole link 130, a tie bar 132 and first and second tie rods 134 and 136.

Figure 7:
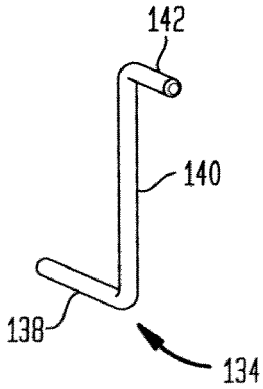
FIG. 7 is a perspective view of a tie rod of a center control module of the switching device of FIG. 5.

Referring to FIG. 7, the first tie rod 134 comprises a double bent elongate rod including a long end 138 connected via a ninety degree turn to a central portion 140 connected via another ninety degree turn to a shorter end 142. As is apparent, the long end 138 extends in an opposite direction relative to the shorter end 142. The second tie rod 136 is identical. The longer end 138 functions as a wrist pin, as described below.

Figure 8:
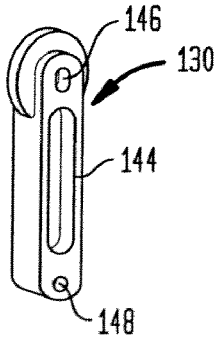
FIG. 8 is a perspective view of a center pole link of the center control module of the switching device of FIG. 5.

Referring to FIG. 8, the center pole link 130 is of one piece plastic construction comprising an elongate body 144 having a slot 146 at one end and an opening 148 at an opposite end.

Figure 9:
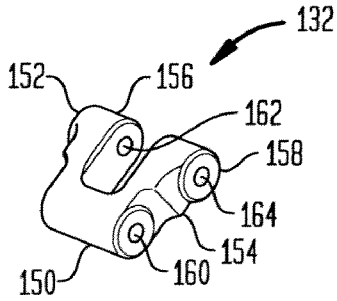
FIG. 9 is a perspective view of a tie bar of the center control module of the switching device of FIG. 5.

Referring to FIG. 9, the tie bar 132 comprises a shoulder 150 connected between opposite arms 152 and 154. Hubs 156 and 158 are connected at distal ends of the respective arms 152 and 154. A through opening 160 is provided through the shoulder 150. Through openings 162 and 164 are provided through the respective hubs 156 and 158.

Figure 11A:
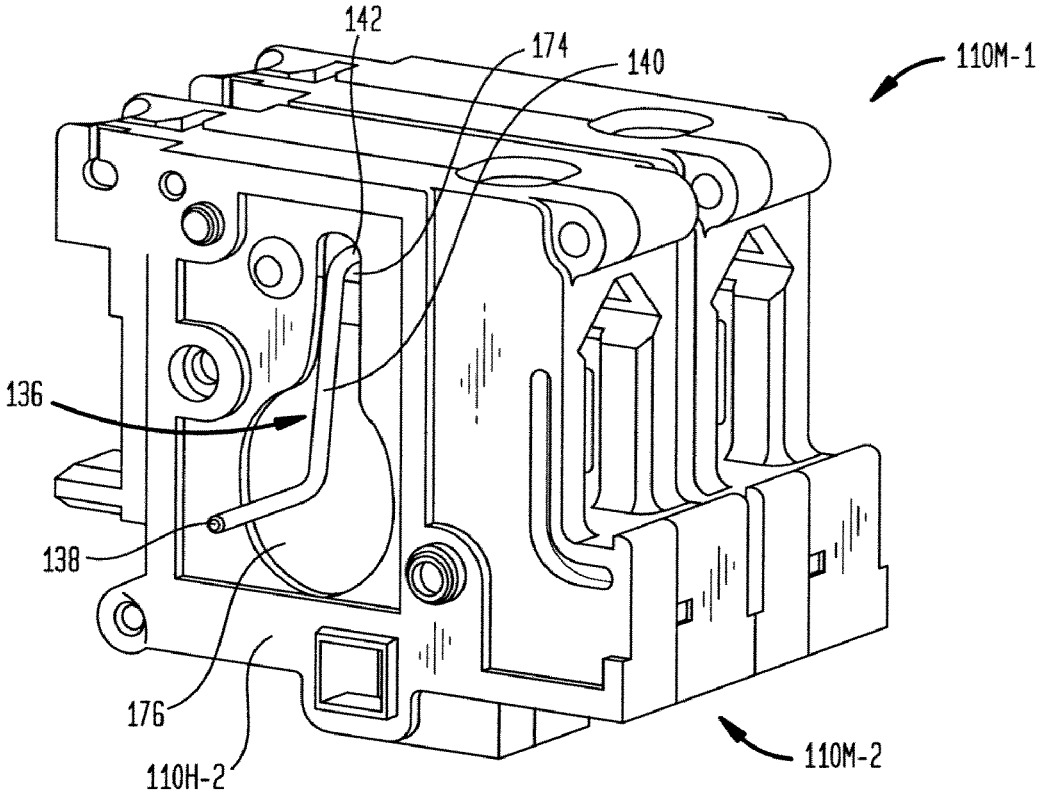
FIG. 11A is a perspective view of a first control module and a second control module of the switching device of FIG. 5, mounted side by side, including a tie rod.
Figure 11B:
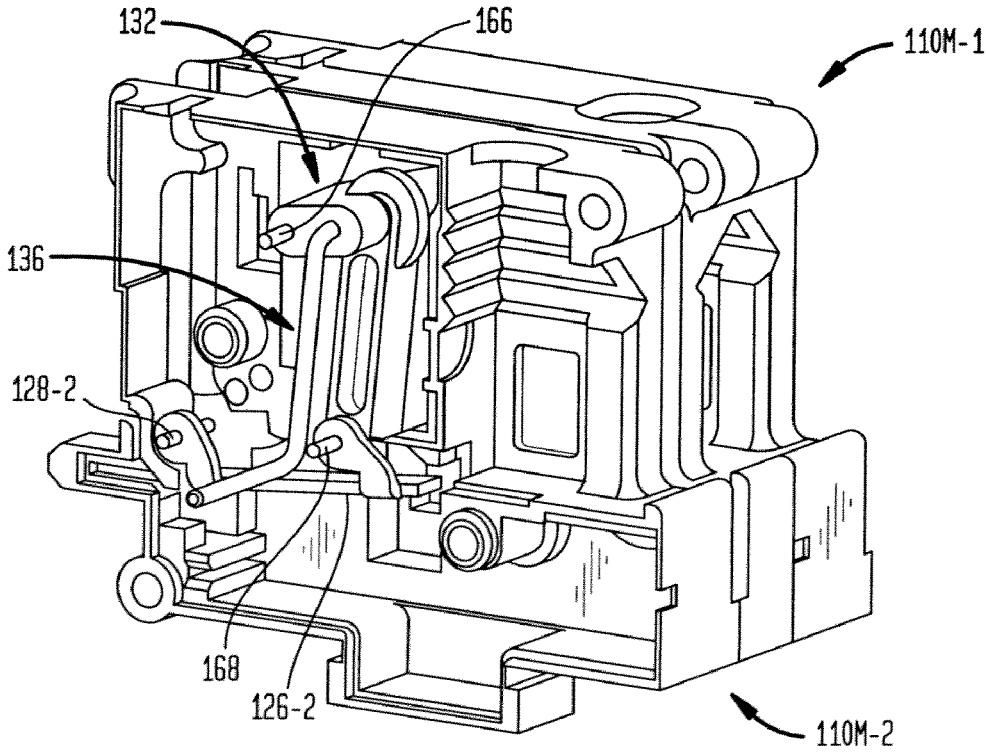
FIG. 11B is a perspective view, similar to FIG. 11A, with a portion of the housing of the second control module and internal components thereof removed for clarity.
Figure 12A:
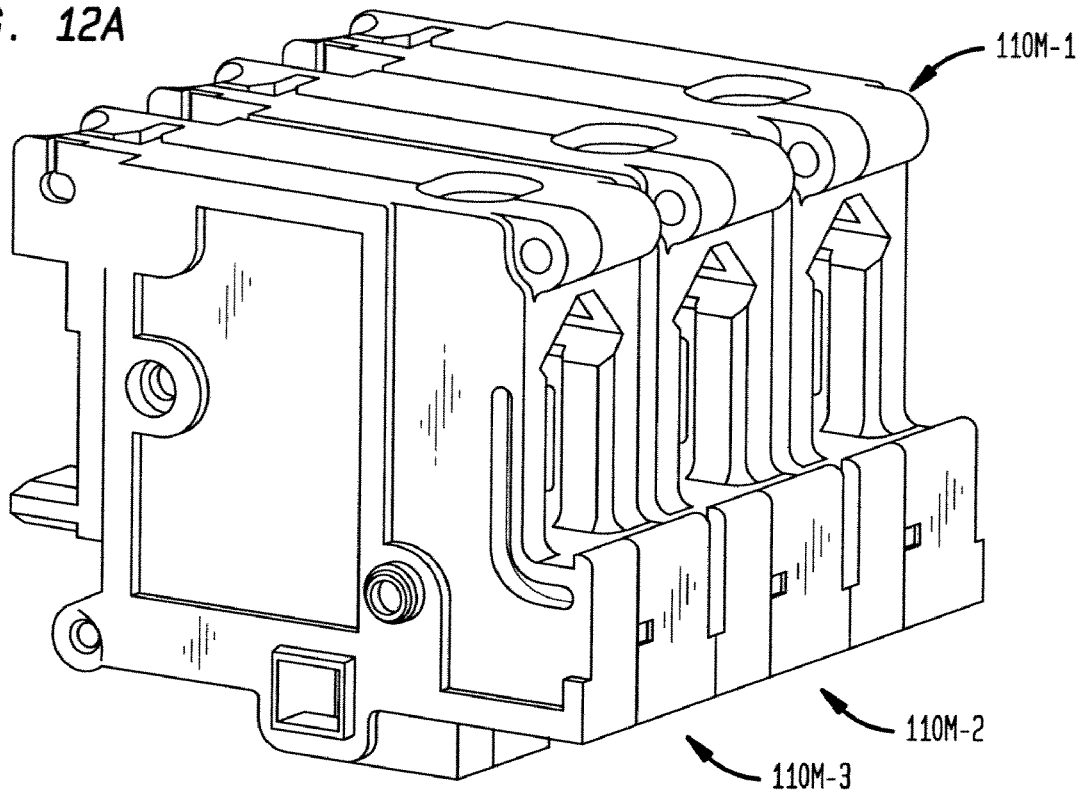
FIG. 12A is a perspective view of the three pole switching device of FIG. 5.
Figure 12B:
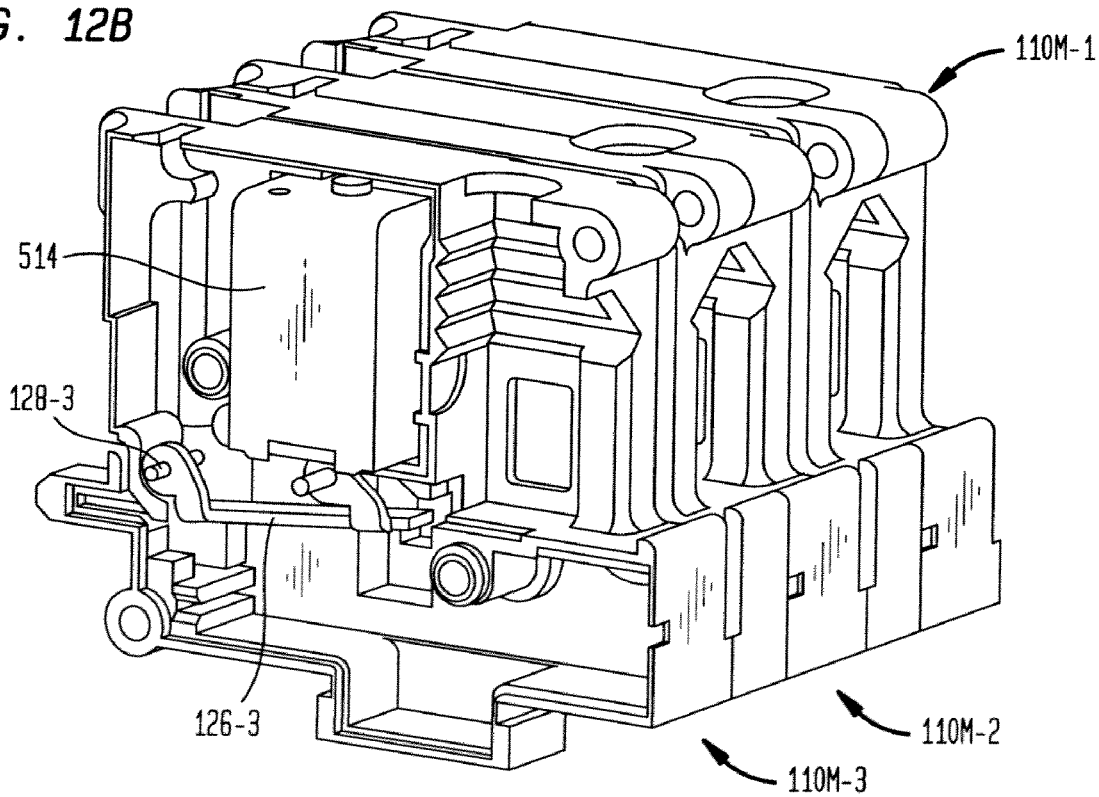
FIG. 12B is a perspective view, similar to that of FIG. 12A, with a portion of the housing of the third control module and internal components thereof removed for clarity.

Referring to FIG. 6, a rod 166 is received in the tie bar shoulder through opening 160 to pivotally mount the tie bar 132 in the second control module 110M-2, see also FIG. 11B. The short ends 142 of the tie rods 134 and 136 extend through the respective tie bar hub through openings 162 and 164 into the center pole link slot 146. The longer end 138 of the first tie rod 134 acts as a wrist pin connecting the first control module plunger 530 to a contact arm 126-2. The contact arm 126-2 is pivotally mounted in the first control module housing 110H-1 using a pivot pin 128-1. Similarly, the longer end 138 of the second tie rod 136 acts as a wrist pin to connect the second control relay plunger 532 to the third control module contact arm 126-3. The contact arm 126-3 is pivotally mounted in the third control module housing 110H-3 using the pivot pin 128-3.

A wrist pin 168 in the second control module housing 110H-2 extends through openings in a contact arm 126-2 and the link opening 148, see also, FIG. 11B.

Figure 10A:
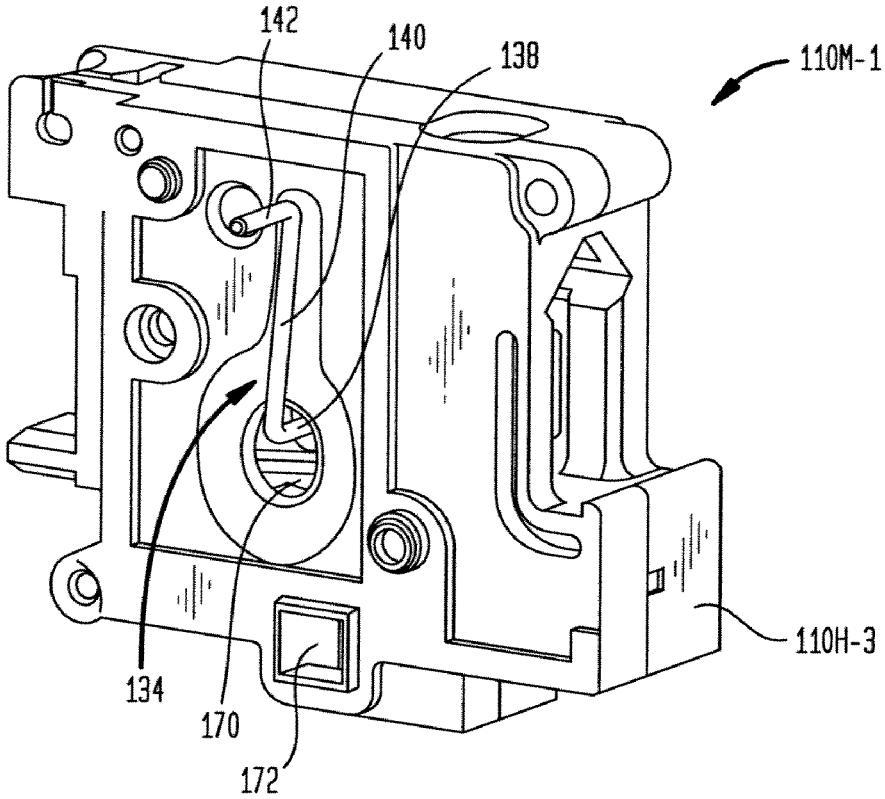
FIG. 10A is a perspective view of a first control module of the switching device of FIG. 5, including a tie rod.
Figure 10B:
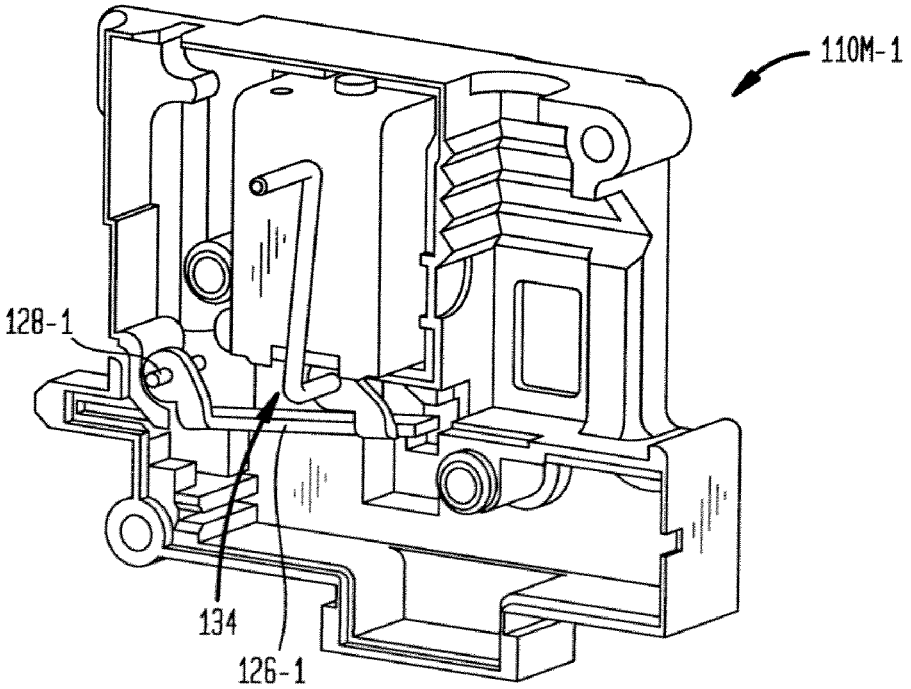
FIG. 10B is a perspective view, similar to FIG. 10A, with a portion of a housing removed and internal components thereof removed for clarity.

Referring to FIG. 10A, the side of the first control module housing 110H-1, to be mounted adjacent the second control module 110M-2, includes a through opening 170 for receiving the longer end 138 of the first tie rod 134. The opening 170 is surrounded by a recess 172. Although not explicitly shown, a similar opening and recess are provided in the third control module housing 110H-3 on the side adjoining the second control module 110M-2.

Referring to FIG. 11A, the second control module housing 110H-2 includes an opening 174 at its upper end for receiving the shorter end 142 of the second tie rod 136. A recess 176 is provided in the side of the housing, similar to the recess 172, discussed above. Although not shown, the opposite side of the second control module 110H-2 includes a similar opening and recess. The recesses in adjacent housings are provided so that when the housings are mounted side by side, there is room for the tie rod central portion 140 to move while allowing minimal tilt.

The tie bar 132, center pole link 132 and the two tie rods 134 and 136 form a tie linkage to mechanically tie the first control module plunger 530 and contact arm 126-1 and the third control module plunger 532 and contact arm 126-3 to the center pole link 130 and second control module contact arm 126-2, as is particularly illustrated in FIG. 6. The housings 110H-1 and 110H-2 sandwich the first tie rod 134 and the housings 110H-2 and 110H-3 sandwich the second tie rod 136. As described above, the solenoid coils 512 and 514 are electrically operated together so that both the first and third poles are in the same operating position. In accordance with the invention, the tie bar 132 and the tie rods 134 and 136 mechanically maintain the contact arms 126-1, 126-2 and 126-3 in the same operating position by allowing at most a minimal tilt of the tie bar 132 and the tie rods 134 and 136. Similarly, the tie linkage is operable to mechanically actuate the center pole link 130. Thus, even if one of the coils 512 or 514 failed, the mechanical linkage ensures that all three poles are in the same operating position.

Although not shown, an operating spring in each of the housings 110H-1, 110H-2 and 110H-3 biases the respective contact arms 126-1, 126-2 and 126-3 so that normally the associated movable contact is an electrical contact with the fixed contact. When the solenoids 512 and 514 are latched, the plungers 530 and 532 raise the contact arms 126-1 and 126-3 via the tie rod longer ends 138 to space the movable contacts 122 from the fixed contacts 120. The movement of the tie rods 134 and 136 pivots the tie bar 132 upwardly to raise the center pole link 130 and thus raise the second control module contact arm 126-2 via the wrist pin 168 to space the movable contact from the fixed contact of the contact AC, see schematic of FIG. 3. When the solenoid 512 and 514 are unlatched, movement is in the opposite direction to return the contacts to the closed position.

Thus, as described, there are separate magnetically latching solenoids 512 and 514 for the two outermost poles and no solenoid in the center pole. The tie bar 132 provides stabilization and is located in a space that would normally contain the solenoid. The tie bar 132 prevents tilt and is linked to the contact arms 126-1 and 126-3 contained in the outer poles using the Z-shaped rods 134 and 136. The contact arm 126-2 of the center pole is linked to the stabilizing tie bar 132 using the link 130 that is about the same length as the Z-shaped rods 134 and 136 but has a slot 146 to compensate for contact wear. Since the stabilizing tie bar 132 and the center pole link 130 are tied together, this ensures that all poles are in the same open or closed position. This not only eliminates the third magnetically latching solenoid, but also reduces parts as there is only a need to drive two solenoids instead of three solenoids.

Thus, the multi-pole switching device 110M includes a single control circuit which simultaneously operates both control relays CR1 and CR2. This controls both to be in the same operating position. The disclosed tie linkage mechanically prevents the individual poles from being in different operating positions.

The general configuration of the control relays 110M-1, 110M-2 and 110M-3 is presented by way of example. The tie linkage in accordance with the invention could be used with other configurations of relays adapted to form a multipole relay. While the disclosed configuration is advantageously used in a distribution panel, the tie linkage could similarly be used with stand-alone devices or the like.

I claim:

1. A multipole switching device for selectively switching electrical power from an electrical power source to a load circuit comprising:

a first control device comprising a housing mountable in a panel, an electromechanical actuator in the housing including a moveable plunger, and an electrical switch in the housing operated by the plunger to open and close the electrical switch;

a second control device comprising a housing mountable in a panel, adjacent the first control device, a mechanical actuator in the housing including a moveable link, and an electrical switch in the housing operated by the moveable link to open and close the electrical switch;

a third control device comprising a housing mountable in a panel, adjacent the second control device, an electromechanical actuator in the housing including a moveable plunger, and an electrical switch in the housing operated by the plunger to open and close the electrical switch; and a tie linkage to mechanically tie the first control device plunger and the third control device plunger to the moveable link.

2. The multipole switching device of claim 1 wherein the tie linkage comprises first and second rods operatively associated with the respective first control device plunger and the third control device plunger.

3. The multipole switching device of claim 2 wherein the tie linkage further comprises a tie bar in the second control device housing operatively coupled to the first and second rods and to the moveable link.

4. The multipole switching device of claim 3 wherein the tie bar is pivotally mounted in the second control device housing and has opposite hubs receiving the first and second rods.

5. The multipole switching device of claim 4 wherein the first and second rods extend into a slot in the moveable link.

6. The multipole switching device of claim 2 wherein the first and second rods comprise double bent rods.

7. The multipole switching device of claim 2 wherein the first rod mechanically links the plunger to a contact arm of the first control device electrical switch and the second rod mechanically links the plunger to a contact arm of the third control device electrical switch.

8. The multipole switching device of claim 2 wherein the moveable link comprises an elongate bar having a slot receiving the first and second rods to compensate for contact wear and having an opening receiving a wrist pin mechanically linking the moveable link to a contact arm of the second control device electrical switch.

9. The multipole switching device of claim 1 wherein the electromechanical actuators comprise solenoids.

10. A three pole switching device for selectively switching electrical power from an electrical power source to a load circuit comprising:

a first control module comprising a housing mountable in a panel, an electro-mechanical actuator in the housing including a moveable plunger, and an electrical switch in the housing comprising a fixed contact and a moveable contact, the moveable contact being carried on a contact arm operated by the plunger to open and close the electrical switch;

a second control module comprising a housing mountable in a panel adjacent the first control module, a mechanical actuator in the housing including a moveable link, and an electrical switch in the housing comprising a fixed contact and a moveable contact, the moveable contact being carried on a contact arm operated by the moveable link to open and close the electrical switch; and a third control module comprising a housing mountable in a panel adjacent the second control module, an electromechanical actuator in the housing including a moveable plunger, and an electrical switch in the housing comprising a fixed contact and a moveable contact, the moveable contact being carried on a contact arm operated by the plunger to open and close the electrical switch; and a tie linkage to mechanically tie the first control module contact arm and the third control module contact arm to the moveable link.

11. The three pole switching device of claim 10 wherein the tie linkage comprises first and second rods operatively associated with the respective first control module plunger and the third control module plunger.

12. The three pole switching device of claim 11 wherein the tie linkage further comprises a tie bar in the second control module housing operatively coupled to the first and second rods and to the moveable link.

13. The three pole switching device of claim 12 wherein the tie bar is pivotally mounted in the second control module housing and has opposite hubs receiving the first and second rods.

14. The three pole switching device of claim 13 wherein the first and second rods extend into a slot in the moveable link.

15. The three pole switching device of claim 10 wherein the first and second rods comprise double bent rods.

16. The three pole switching device of claim 11 wherein the first rod mechanically links the plunger to the contact arm of the first control module electrical switch and the second rod mechanically links the plunger to the contact arm of the third control module electrical switch.

17. The three pole switching device of claim 11 wherein the moveable link comprises an elongate bar having a slot receiving the first and second rods to compensate for contact wear and having an opening receiving a wrist pin mechanically linking the moveable link to a contact arm of the second control module electrical switch.

18. The three pole switching device of claim 10 wherein the electromechanical actuators comprise solenoids.

* * * * *